US010147389B2

(12) United States Patent
Liu et al.

(10) Patent No.: US 10,147,389 B2
(45) Date of Patent: Dec. 4, 2018

(54) CONTROL CIRCUIT AND ASSOCIATED CONTROL METHOD APPLIED TO DIGITAL VISUAL INTERFACE

(71) Applicant: MStar Semiconductor, Inc., Hsinchu Hsien (TW)

(72) Inventors: Ming-Ruei Liu, Hsinchu County (TW); Dien-Shen Chiang, Hsinchu County (TW)

(73) Assignee: MSTAR SEMICONDUCTOR, INC., Hsinchu Hsien (TW)

( * ) Notice: Subject to any disclaimer, the term of this patent is extended or adjusted under 35 U.S.C. 154(b) by 102 days.

(21) Appl. No.: 15/200,292

(22) Filed: Jul. 1, 2016

(65) Prior Publication Data

US 2017/0025087 A1 Jan. 26, 2017

(30) Foreign Application Priority Data

Jul. 20, 2015 (TW) ..... 104123379 A

(51) Int. Cl.
*G09G 5/00* (2006.01)

(52) U.S. Cl.
CPC ..... *G09G 5/006* (2013.01); *G09G 5/003* (2013.01); *G09G 2370/047* (2013.01); *G09G 2370/12* (2013.01); *G09G 2370/22* (2013.01)

(58) Field of Classification Search
CPC ..... G09G 5/005; G09G 5/006; G09G 5/003; G09G 2370/12; G09G 2370/22; G09G 2370/047
USPC ..... 345/1.1, 204, 214; 710/62, 316
See application file for complete search history.

(56) References Cited

U.S. PATENT DOCUMENTS 7,598,948 B1 * 10/2009 Priem ..... G09G 5/00 345/204
8,019,905 B2 * 9/2011 Wu ..... G09G 5/006 345/214
2004/0119731 A1 * 6/2004 Lee ..... G09G 5/006 345/699
2005/0162336 A1 * 7/2005 McClintock ..... G06F 3/1431 345/1.1
2006/0092152 A1 * 5/2006 Jang ..... G09G 5/006 345/211
2007/0009183 A1 * 1/2007 Kim ..... G06F 1/3203 382/312
2007/0025087 A1 * 2/2007 Chen ..... H05K 7/209 361/704
2007/0171305 A1 * 7/2007 Kim ..... G09G 5/008 348/563
2007/0210984 A1 * 9/2007 Choi ..... G09G 5/006 345/3.1

(Continued)

FOREIGN PATENT DOCUMENTS

CN 101040253 A 9/2007
CN 102137255 7/2011
CN 201910222 7/2011

*Primary Examiner* — Prabodh M Dharia
(74) *Attorney, Agent, or Firm* — WPAT, PC

(57) ABSTRACT

A control circuit applied to digital visual interface (DVI) includes a detecting circuit and a switching circuit. The detecting circuit detects a state of a predetermined pin of a DVI connector to generate a control signal. The switching circuit selectively connects a first pin and a second pin of the DVI connector to one a storage unit storing first identification data and a storage unit storing second identification data according to the control signal.

12 Claims, 5 Drawing Sheets

(56) References Cited

U.S. PATENT DOCUMENTS

2008/0084359 A1* 4/2008 Giannuzzi ..... G09G 5/006 345/1.1
2008/0136803 A1* 6/2008 Slaton ..... G06F 3/14 345/211
2009/0051693 A1* 2/2009 Rokushima ..... G09G 5/006 345/520
2009/0115753 A1* 5/2009 Chen ..... G09G 5/003 345/204
2010/0097357 A1* 4/2010 Lin ..... G06F 3/14 345/204
2010/0180055 A1* 7/2010 Lyon ..... G06F 3/023 710/62
2010/0298029 A1* 11/2010 Jang ..... G06F 1/266 455/557
2011/0062780 A1* 3/2011 Verges ..... H02J 13/001 307/38
2011/0097910 A1* 4/2011 Lu ..... H01R 13/6477 439/78
2011/0256756 A1* 10/2011 Lu ..... H01B 7/0892 439/449
2012/0290761 A1* 11/2012 Chen ..... G06F 13/4045 710/305
2012/0307436 A1* 12/2012 Dickens ..... H01R 13/6461 361/679.02
2013/0073775 A1* 3/2013 Wade ..... G06F 13/4022 710/316
2016/0004650 A1* 1/2016 Yamasaki ..... G06F 13/102 710/63
2016/0360122 A1* 12/2016 Miyamoto ..... H04N 5/268

* cited by examiner

CONTROL CIRCUIT AND ASSOCIATED CONTROL METHOD APPLIED TO DIGITAL VISUAL INTERFACE

This application claims the benefit of Taiwan application Serial No. 104123379, filed Jul. 20, 2015, the subject matter of which is incorporated herein by reference.

BACKGROUND OF THE INVENTION

Field of the Invention

The invention relates in general to a display device, and more particularly to a control circuit and associated control method applied to Digital Visual Interface (DVI).

Description of the Related Art

Conventionally, when a Digital Visual Interface (DVI) connector of a display device connects to a display card of an image transmitter (e.g., a computer host) through a connecting cable, the display card directly reads extended display identification data (EDID) stored in the display device, and transmits display data according to the EDID to the display device. The selection of the EDID is set using an on-screen display (OSD) by a user. When the user sets the display device to be in a Digital Visual Interface-Analog (DVI-A) (or referred to as Video Graphics Array (VGA)) mode, the display card has access to only the EDID of DVI-A. Similarly, when the user sets the display device to be in a Digital Visual Interface-Digital (DVI-D) mode, the display card has access to only the EDID of DVI-D.

As previously described, the EDID that the display card reads is determined according to the user setting, and so it is probable that the display card receives incorrect EDID that may lead to subsequent display errors and operation complications. For example, assume that the display card transmits digital signals and is connected to the display device through a DVI-D connecting cable, and the setting of the display device is the DVI-A mode. At this point, the display card reads the EDID of DVI-A, and determines that the DVI-A is not supported. Thus, the display card does not transmit any display data to the display device. Further, there is no use if the user again sets the display device to the DVI-D mode, as the display card does not again read the EDID stored in the display device. In the above situation, the user can only again set the display device to the DVI-D mode and unplug and re-plug the connecting cable, and the display device is then able to display normally.

On the other hand, assume that the display card transmits analog signals, the connecting cable is a DVI-A (or VGA) connecting cable, and the display device is set to the DVI-D mode. At this point, the display card reads the EDID of DVI-D, and transmits display data with incorrect timing to the display device. In the above situation, the user can only again set the display device to the DVI-A mode and unplug and re-plug the connecting cable, so as to be able to view a correct display image.

SUMMARY OF THE INVENTION

The invention is directed to a control circuit and associated method applied to Digital Video Interface (DVI). The control circuit and associated method are capable of determining whether a connecting cable connected to a display device is a DVI-D connecting cable or a DVI-A connecting cable, and ensuring that the display card reads correct extended display identification data (EDID), thereby solving issues of the prior art.

According to an embodiment of the present invention, a control circuit applied to DVI includes a detecting circuit and a switching circuit. The detecting circuit detects a state of a predetermined pin of a DVI connector to generate a control signal. The switching circuit selectively connects a first pin and a second pin of the DVI connector to one of a first storage unit storing first identification data and a second storage unit storing second identification data according to the control signal.

According to another embodiment of the present invention, a control method applied to DVI includes: detecting a state of a predetermined pin of a DVI connector to generate a control signal; and selectively connecting a first pin and a second pin of the DVI connector to one of a first storage unit storing first identification data and a second storage unit storing second identification data according to the control signal.

The above and other aspects of the invention will become better understood with regard to the following detailed description of the preferred but non-limiting embodiments. The following description is made with reference to the accompanying drawings.

DETAILED DESCRIPTION OF THE INVENTION

Figure 1:
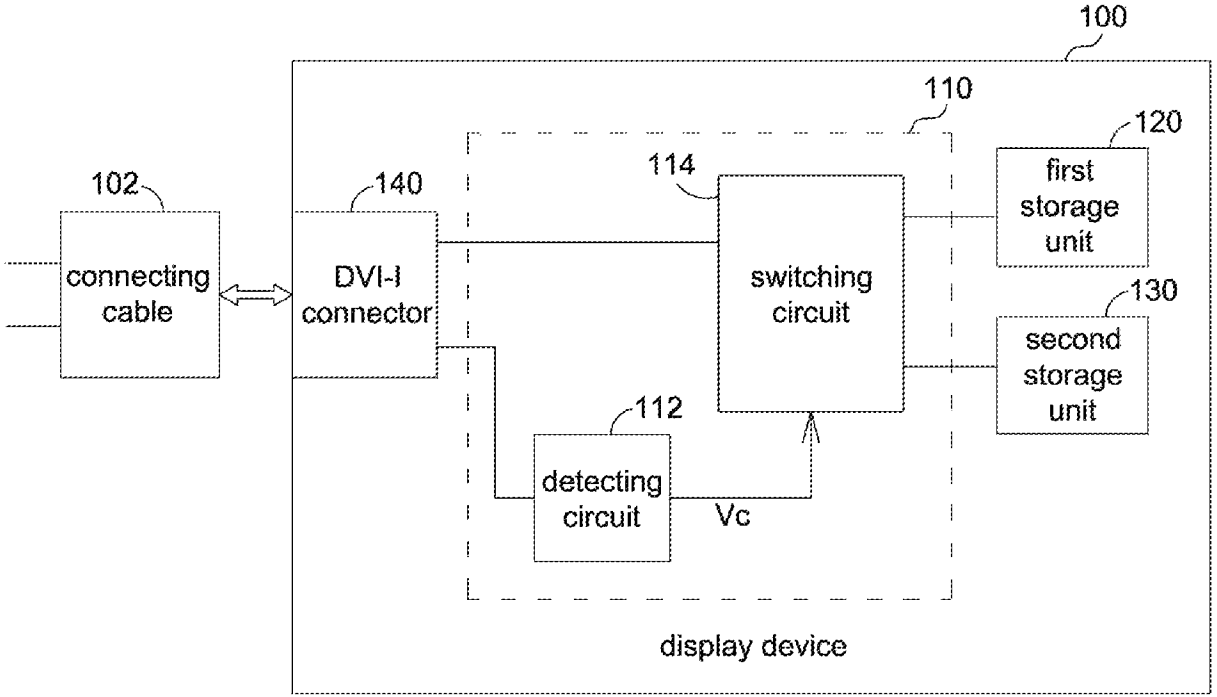
FIG. 1 is a block diagram of a display device according to an embodiment of the present invention.

FIG. 1 shows a block diagram of a display device 100 according to an embodiment of the present invention. As shown in FIG. 1, the display device 100 includes a control circuit 110, a first storage unit 120, a second storage unit 130 and a Digital Visual Interface-Integrated (DVI-I) connector 140. The control circuit 110 includes a detecting circuit 112 and a switching circuit 114. In the embodiment, the first storage unit 120 stores first identification data, e.g., analog extended display identification data (EDID) (or referred to as Video Graphics Array (VGA) EDID). Further, for example, the first storage unit 120 may be implemented by an electrically-erasable programmable read-only memory (EEPROM) or other suitable storage units. The second storage unit 130 stores second identification data, e.g., digital EDID in this embodiment (or referred to as DVI EDID). Further, for example, the second storage unit 130 may also be implemented by EEPROM, or other suitable storage units.

The DVI-I connector 140 connects to a connecting cable 102, and the display device 100 receives analog or digital data from a display card through the connecting cable 102. For example, the connecting cable 102 may be a DVI-A connecting cable (or referred to as a VGA transmission cable), or a DVI-D connecting cable (or referred to as a DVI transmission cable). Further, as details of receiving and processing the display data are not the focus of discussion of the present invention, and so associated receiving and processing circuits are omitted in FIG. 1.

Figure 2:
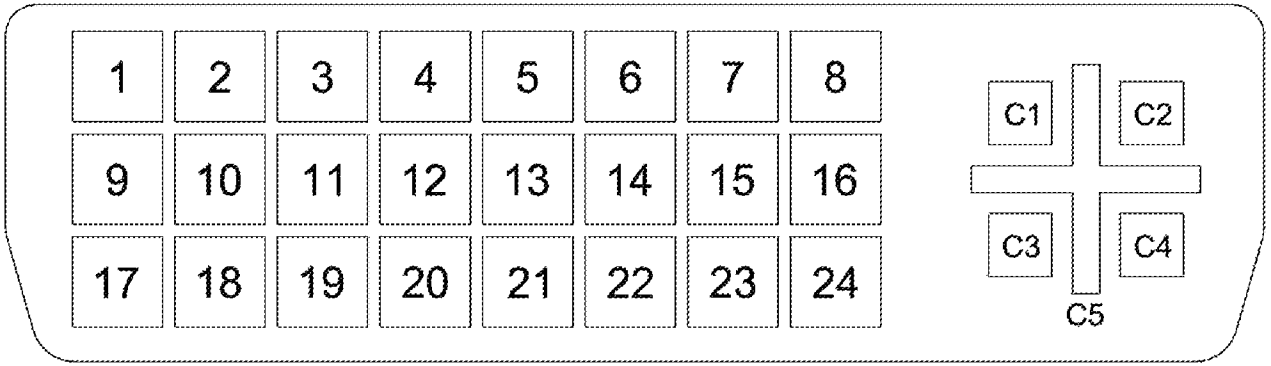
FIG. 2 is a schematic diagram of a Digital Visual Interface-Integrated (DVI-I) connector.

In the display device 100 in FIG. 1, when the connecting cable 102 connects to the DVI-I connector 140, the detecting circuit 112 detects a state of a predetermined pin of the DVI-I connector 140, so as to determine whether the connecting cable 102 is a DVI-A connecting cable or a DVI-D connecting cable to generate a control signal Vc. More specifically, referring to FIG. 2 showing a schematic diagram of the DVI-I connector 140, the DVI-I connector 140 includes 29 pins numbered 1 to 24 and C1 to C5. Functions of individual pins are known to one person skilled in the art, and shall be omitted herein. In the embodiment, the predetermined pin may be pin 3, 11, 19 or 22. In related DVI specifications, when the connecting cable 102 is a DVI-D connecting cable and the input signal is a digital signal, the pin 3, 11, 19 or 22 is defined as a data shield or a clock shield, and is connected to the ground. When the connecting cable 102 is a DVI-A connecting cable and the input signal is an analog signal, the pin 3, 11, 19 or 22 is defined as floating. Thus, the detecting circuit 112 in this embodiment detects whether the predetermined pin is in a floating state or a grounded state to determine whether the connecting cable 102 is a DVI-A connecting cable or a DVI-D connecting cable.

When the detecting circuit 112 detects that the predetermined pin is in a floating state, it determines that the connecting cable 102 is a DVI-A connecting cable, and transmits the control signal Vc to the switching circuit 114 to control the switching circuit 114 to connect the DVI-I connector 140 to the first storage unit 120. Thus, the display card is able to connect to the first storage unit 120 through the connecting cable 102, the DVI-I connector 140 and the switching circuit 114, and to read the DVI-A EDID stored in the first storage unit 120. On the other hand, when the detecting circuit 112 detects that the predetermined pin is in a grounded state, it determines that the connecting cable 102 is a DVI-D connecting cable, and transmits the control signal Vc to the switching circuit 114 to control the switching circuit 114 to connect the DVI-I connector 140 to the second storage unit 130. Thus, the display card is able to connect to the second storage unit 130 through the connecting cable 102, the DVI-I connector 140 and the switching circuit 114, and to read the DVI-D EDID stored in the second storage unit 130. As previous stated, since the control circuit 110 is capable of automatically and correctly connecting the DVI-I connector 140 to the appropriate storage unit, it is ensured that the display card is able to read the correct EDID, thereby preventing the issue of reading incorrect EDID as in the prior art.

The operations of the detecting circuit 112 and the switching circuit 114 are persistently and uninterruptedly performed. That is, in the event that the DVI-I connector 140 is connected to a different connecting cable, the detecting circuit 112 and the switching circuit 114 are allowed to immediately connect the DVI-I connector 140 to an appropriate storage unit.

Further, as previously described, the VGA display card is still able to continue transmitting the display data to the display device 100 when having read incorrect EDID, but the DVI display card does not transmit the display data when having read incorrect EDID. Thus, considering the above situation, in one embodiment, in a predetermined condition, the switching circuit 114 connects the DVI-I connector 140 to the second storage unit 130. Thus, even in the event of misjudgment, as the VGA display card still continues transmitting data and the display device still displays an image (which may be an incorrect image), the user may accordingly unplug and re-plug the connector to again perform the detection.

Figure 3:
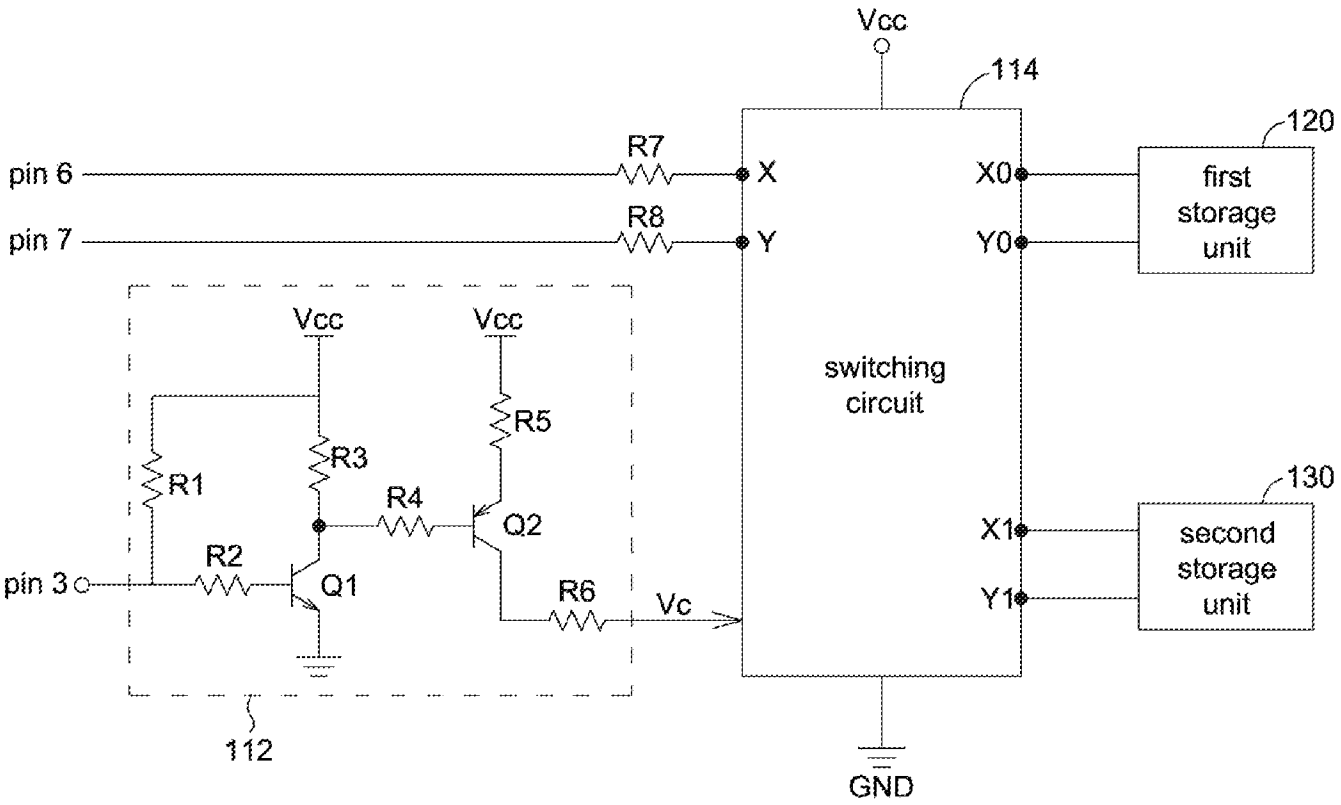
FIG. 3 is a block diagram of a detecting circuit and a switching circuit according to an embodiment of the present invention.

FIG. 3 shows a block diagram of the detecting circuit 112 and the switching circuit 114 according to an embodiment of the present invention. It should be noted that, the circuit structure in FIG. 3 is for illustrating details of operations and possible implementation of the detecting circuit 112 and the switching circuit 114, and is not to be construed as a limitation to the present invention. As shown in FIG. 3, the detecting circuit 112 includes transistors Q1 and Q2 and multiple resistors R1 to R6, and is capable generating the control signal Vc according to the state of the pin 3 (or the pin 11, 19 or 22). Terminals X and Y of the switching circuit 114 are connected to the pins 6 and 7 of the DVI-I connector 140 via resistors R7 and R8, respectively. The pin 6 is for the display card to transmit a clock to the display device, and the pin 7 is for the display card to transmit a request command to the display device to read the EDID and for the display device to transmit the EDID to the display card. The switching circuit 114 selectively connects the terminals X and Y to terminals X0 and Y0 or to terminals X1 and Y1 according to the control signal Vc. More specifically, when the pin 3 is in a floating state, the control signal Vc is at a high voltage level. At this point, the switching circuit connects the terminals X and Y to the terminals X0 and Y0, respectively, to allow the display card to read the DVI-A EDID stored in the first storage unit 120 through the pins 6 and 7 of the DVI-I connector 140. On the other hand, when the pin 3 is in a grounded state, the control signal Vc is at a low voltage level. At this point, the switching circuit connects the terminals X and Y to the terminals X1 and Y1, respectively, to allow the display card to read the DVI-D EDID stored in the second storage unit 130 through the pins 6 and 7 of the DVI-I connector 140.

Figure 4:
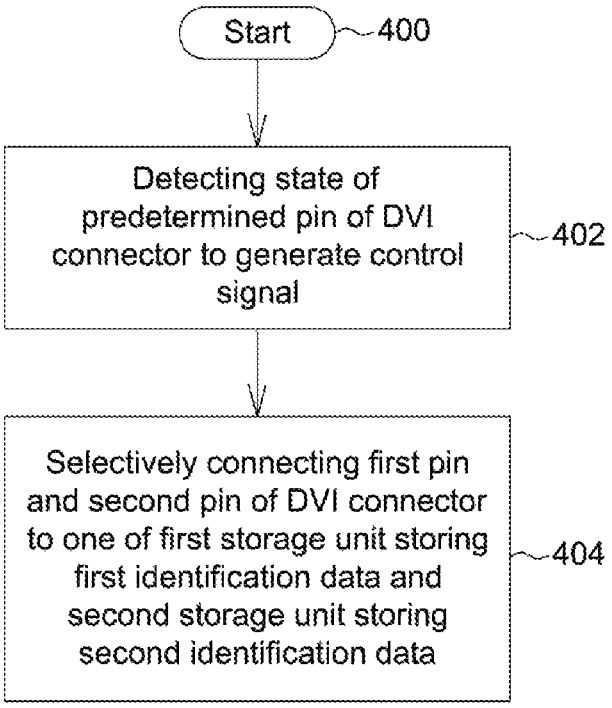
FIG. 4 is a flowchart of a control method applied to DVI according to an embodiment of the present invention.

FIG. 4 shows a flowchart of a process of a control method applied to DVI according to an embodiment of the present invention. Referring to FIG. 4, the control method includes following steps.

In step 400, the process begins.

In step 402, a state of a predetermined pin of a DVI-I connector is detected to generate a control signal.

In step 404, a first pin and a second pin of the DVI-I connector are selectively connected to one of a first storage unit storing first identification data and a second storage unit storing second identification data according to the control signal.

In the above embodiments, the detecting circuit 112 detects the state of only one pin to generate the control signal Vc. In other embodiments of the present invention, the detecting circuit may also simultaneously detect the state of another predetermined pin of the DVI-I connector, and generate the control signal Vc simultaneously according to the states of the two predetermined pins, so as to prevent the malfunction of one of the predetermined pins. More specifically, the two predetermined pins may be any two pins of the pins 3, 11, 19 and 22 of the DVI-I connector 140, e.g., the pins 3 and 19. The detecting circuit may detect whether each of the pins 3 and 19 is in a floating state or a grounded state, and determine whether the connecting cable 102 is a DVI-A connecting cable or a DVI-D connecting cable according to the detection results. On the other hand, similarly, the detecting circuit may also simultaneously detect the states of three or four predetermined pins of the DVI-I connector 140, e.g., detecting the states of any three pins of the pins 3, 11, 19 and 22, or detecting the states of all of the pins 3, 11, 19 and 22, and determine whether the connecting cable 102 is a DVI-A connecting cable or a DVI-D connecting cable according to the detection results in a statistical approach.

Figure 5:
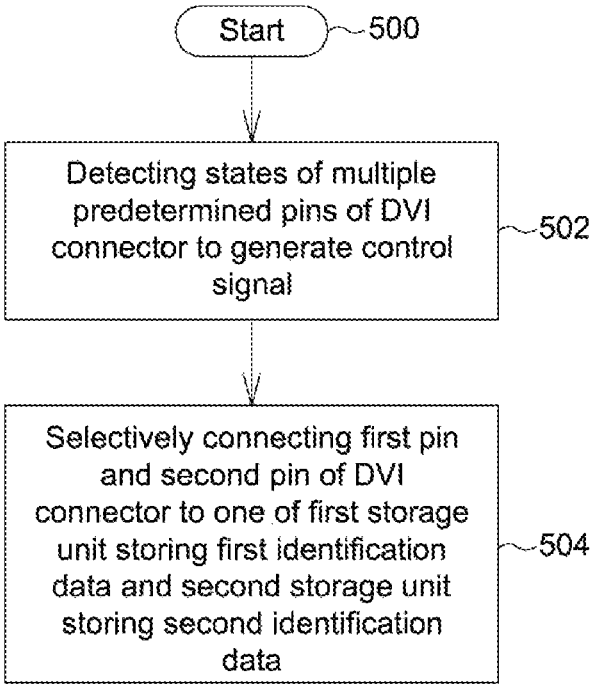
FIG. 5 is a flowchart of a control method applied to DVI according to another embodiment of the present invention.

FIG. 5 shows a flowchart of a process of a control method applied to DVI according to yet another embodiment of the present invention. Referring to FIG. 5, the method includes following steps.

In step 500, the process begins.

In step 502, states of multiple predetermined pins of a DVI connector are detected to generate a control signal.

In step 504, a first pin and a second pin of the DVI connector are selectively connected to one of a first storage unit storing first identification and a second storage unit storing second identification data according to the control signal.

In conclusion, in the control circuit and control method applied to DVI of the present invention, it is determined whether a connecting cable of a display device is a DVI-D connecting cable or a DVI-A connecting cable according to the state of a predetermined pin of a connector, and the connector is connected to correct storage unit. Thus, it is ensured that the display card is able to read correct EDID to prevent the issue that the display card reads incorrect EDID as in the prior art.

While the invention has been described by way of example and in terms of the preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A control circuit applied to Digital Visual Interface (DVI), comprising:

a detecting circuit, detecting whether a state of a predetermined pin of a DVI connector is one of a floating state while connected to a DVI-A connecting cable and a grounded state while connected to a DVI-D connecting cable to generate a control signal; and a switching circuit, selectively connecting a first pin and a second pin of the DVI connector to one of a first storage unit storing first identification data and a second storage unit storing second identification data according to the control signal;

wherein the first identification data is analog EDID and the second identification data is digital EDID;

wherein, when the detecting circuit detects that the predetermined pin is in the floating state, the switching circuit connects the first pin and the second pin of the DVI connector to the first storage unit according to the control signal; and wherein, when the detecting circuit detects that the predetermined pin is in the grounded state, the switching circuit connects the first pin and the second pin of the DVI connector to the second storage unit according to the control signal.

2. The control circuit according to claim 1, wherein the DVI connector is a Digital Visual Interface Integrated (DVI-I) connector.

3. The control circuit according to claim 2, wherein in a predetermined condition, the switching circuit connects the first pin and the second pin of the DVI connector to the second storage unit.

4. The control circuit according to claim 1, wherein the DVI connector is a Digital Visual Interface Integrated (DVI-I) connector, and the predetermined pin is one of pins 3, 11, 19 and 22 of the DVI-I specification.

5. The control circuit according to claim 4, wherein the detecting circuit further detects a state of another predetermined pin of the DVI connector, and generates the control signal according to the state of the another predetermined pin; the another predetermined pin is another one of the pins 3, 11, 19 and 22 of the DVI-I specification.

6. The control circuit according to claim 1, wherein the control circuit is located in a display device, and the DVI connector is disposed on the display device.

7. A control method applied to Digital Visual Interface (DVI), comprising:

detecting whether a state of a predetermined pin of a DVI connector is one of a floating state while connected to a DVI-A connecting cable and a grounded state while connected to a DVI-D connecting cable to generate a control signal; and selectively connecting a first pin and a second pin of the DVI connector to one of a first storage unit storing first identification data and a second storage unit storing second identification data according to the control signal;

wherein the first identification data is analog EDID and the second identification data is digital EDID:

wherein, when it is detected that the predetermined pin is in the floating state, connecting the first pin and the second pin of the DVI connector to the first storage unit according to the control signal; and when it is detected that the predetermined pin is in the grounded state, connecting the first pin and the second pin of the DVI connector to the second storage unit according to the control signal.

8. The control method according to claim 7, wherein the DVI connector is a Digital Visual Interface-Integrated (DVI-I) connector.

9. The control method according to claim 8, further comprising:

in a predetermined condition, connecting the first pin and the second pin of the DVI connector to the second storage unit.

10. The control method according to claim 7, wherein the DVI connector is a Digital Visual Interface-Integrated (DVI-I) connector, and the predetermined pin is one of pins 3, 11, 19 and 22 of the DVI-I specification.

11. The control method according to claim 10, further comprising:

detecting a state of another predetermined pin of the DVI connector, and generating the control signal according to the state of the another predetermined pin;

wherein, the another predetermined pin is another one of the pins 3, 11, 19 and 22 of the DVI-I specification.

12. The control method according to claim 7, applied to a display device, wherein the DVI connector is disposed on the display device.

* * * * *